US005117609A

United States Patent [19]

Seymour et al.

[11] Patent Number: 5,117,609

[45] Date of Patent: Jun. 2, 1992

[54] APPARQUS AND METHOD FOR APPLYING A MULTI-PACKAGE CARRIER

[75] Inventors: Lonnie R. Seymour; Kevin D. Moore, both of Hoopeston, Ill.

[73] Assignee: Illinois Tool Works, Inc., Chicago, Ill.

[21] Appl. No.: 519,860

[22] Filed: May 7, 1990

[51] Int. Cl.[5] ..... B65B 27/04

[52] U.S. Cl. ..... 53/398; 53/441; 53/48.4; 53/556

[58] Field of Search ..... 53/398, 441, 556, 48, 53/48.3, 48.4

[56] References Cited

U.S. PATENT DOCUMENTS

| | | | |
|---|---|---|---|
| 3,032,943 | 5/1962 | Reimers | 53/48 |
| 3,204,386 | 9/1965 | Creed | 53/48 X |
| 3,328,937 | 7/1967 | Newman | 53/282 |
| 3,775,935 | 12/1973 | Schlueter et al. | 53/48 |
| 3,792,562 | 2/1974 | Gilliam | 53/398 |
| 3,959,949 | 6/1976 | Benno | 53/48 X |
| 3,991,640 | 11/1976 | Schuueter | 53/48 X |
| 4,018,331 | 9/1977 | Klygis | 53/48 X |
| 4,024,950 | 5/1977 | Werth | 206/150 |
| 4,079,571 | 3/1978 | Schlueter et al. | 53/48 |
| 4,250,682 | 2/1981 | Braun | 53/48 |
| 4,305,499 | 12/1981 | Mercer | 53/441 X |
| 4,462,494 | 7/1984 | Cunningham | 53/398 X |
| 4,530,264 | 7/1985 | Felstehausen | 83/175 |
| 4,953,342 | 9/1990 | Hynes | 53/398 |
| 5,054,257 | 10/1991 | Cunningham | 53/48.4 |

*Primary Examiner*—John Sipos

*Attorney, Agent, or Firm*—Trexler, Bushnell, Giangiorgi & Blackstone, Ltd.

[57] ABSTRACT

An apparatus and method for assembling a plurality of articles with carriers in a connected carrier strip. The apparatus and method separates the strip of carriers assembled with a plurality of articles to form discrete packages of a plurality of articles by dividing the carrier strip horizontally tranversely to the path of travel of the articles and the assembled carrier strip. The portion of the apparatus for separating the articles is positionable between groups of articles moving along a path of travel and provides tensioning of the carrier strip between groups of articles to facilitate dividing the carrier strip along weakened lines.

20 Claims, 6 Drawing Sheets

FIG. 10
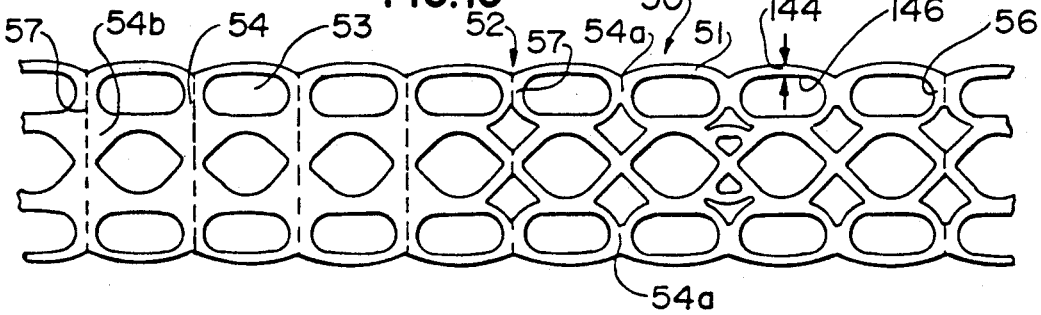
FIG. 12
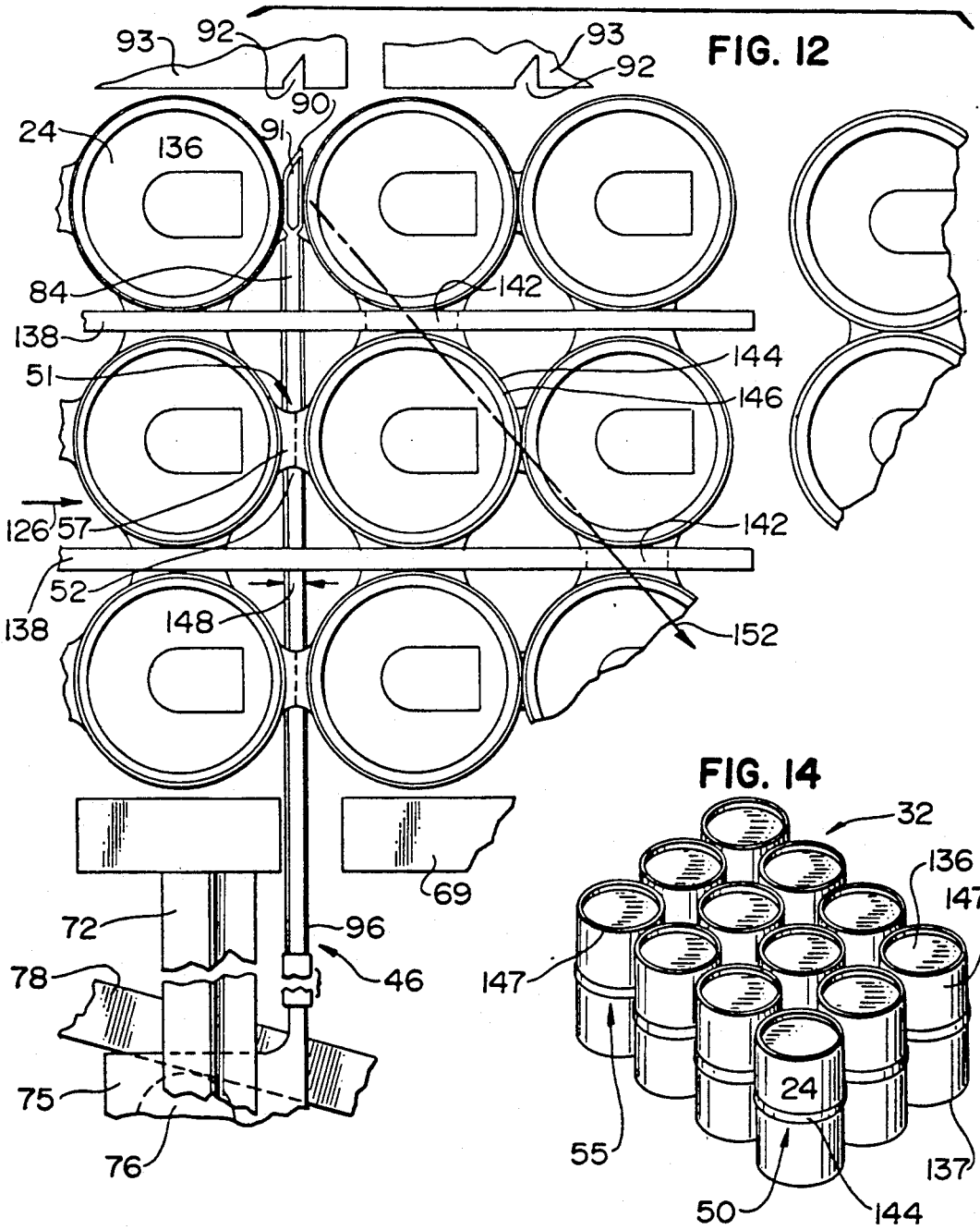
FIG. 14

APPARQUS AND METHOD FOR APPLYING A MULTI-PACKAGE CARRIER

BACKGROUND OF THE INVENTION

This invention relates generally to the article packaging arts and more particularly to a machine and method for assembling a plurality of articles with a packaging carrier.

The prior art discloses various forms of carriers for assembly with articles. For example, U.S. Pat. No. 4,018,331 to Klygis and U.S. Pat. No. 4,219,117 to Weaver et al. are two examples of carriers used to package a plurality of articles in close relation. Generally, this type of carrier is formed of a resilient material which can be deformably stretched. When stretched, openings formed in the material enlarge to permit assembly over the ends of articles. Once the stretching force is removed, the carrier material elastically reforms around the articles. Although these two references show generally cylindrical beverage containers retained within the carrier, articles of other dimensions may be assembled with an appropriately dimensioned carrier strip employing a similar process.

Weaver et al. shows a carrier strip which comprises two rows of longitudinally adjacent bands The Klygis patent shows a carrier strip which is formed with three rows of longitudinally adjacent bands. In both patents, the strip is engaged along the outside edge of the bands and stretched outwardly so that each band forms an opening which complements the article to be assembled therewith. In the Klygis patent, forces exerted on the two outermost bands of each row of three adjacent bands stretch the medial band deforming it to complementarily accommodate an article assembled therethrough.

An apparatus as shown in U.S. Pat. No. 4,250,682 to Braun provides a machine which engages a carrier strip and assembles the carrier strip with a plurality of articles moving in close relation thereto. The apparatus in Braun has a rotary drum with carrier stretching members for engaging, stretching and positioning the carrier strip over the tops of the articles moving thereunder such that the carrier material is retained under the chime of the article. This apparatus positions the articles in relation to the rotary drum and carrier strip using pairs of "star-wheels". The star-wheels engage the sides of the articles generally at a top and bottom position to locate the articles for proper assembly with the carrier.

Once the carrier has been assembled with the articles, the continuous carrier strip is periodically cut to form discrete packages. Preferably, the carrier strip is formed with weakened areas at periodic intervals to promote division into the discrete packages. Typically, the carrier assembled with the articles are divided into discrete packages using an apparatus such as is shown in U.S. Pat. No. 4,530,264 to Felstehausen or U.S. Pat. No. 3,991,640 to Schlueter. The apparatus in Felstehausen vertically transversely divides the carrier strip by cutting vertically downward through the strip. Division of the carrier strip occurs using a blade which is generally vertically perpendicularly positioned relative to the generally horizontal plane of the path of travel of the carrier at the point of division. Schlueter shows a device which separates three columns of articles by using two cutting star wheels which cut the carrier material along the outside edge and a vertical cutter to cut the center material. While devices in both Felstehausen and Schlueter are effective at cutting necked portions of carrier material retained near the top of the articles it is difficult to cut carrier material retained substantially spaced apart from the top and bottom of the articles.

Further, the prior art systems generally depend upon mounting the carrier strip to engage the top chime of the article. An example of such retaining structure is the top chime of a cylindrical beverage container generally formed by joining the top edge of the cylindrical body and the circumferential edge of the top. It is under the chime which an inside edge of the aperture formed through the center of a retaining band is retainably secured. The current beverage container market has decreased the diameter of the top surface and thus the circumference of the chime thereby requiring specialized carrying strips to be manufactured. The problem is exacerbated since the beverage container market has diverged from uniformity in that there are many types of top chimes having varying diameters. However, the diameter of the body of these beverage containers is substantially uniform regardless of the diameter of the top chime. Therefore, it is desirable to produce a uniform carrier strip which can be positioned substantially spaced from the top and bottom of an article since the mid-section of most articles have a generally uniform perimeter.

OBJECTS AND SUMMARY OF THE INVENTION

A general object of the present invention is to provide an apparatus and method which assembles a carrier strip with a plurality of containers and divides the carrier strip into discrete packages at a high rate.

Another object of the present invention is to provide an apparatus and method for dividing the carrier strip assembled with a plurality of articles in a transverse horizontal direction to the path of travel of the articles assembled with the carrier strip.

In accordance with the foregoing, the present invention comprises an apparatus and method for assembling a plurality of articles with carriers in a strip of connected carriers. The apparatus and method separates the strip of carriers to form discrete packages of a plurality of articles by dividing the carrier strip horizontally transversely to the path of travel of the articles and the assembled carrier strip. The portion of the apparatus for separating the articles is positionable between groups of articles moving along a path of travel and provides tensioning of the carrier between groups of articles to facilitate dividing the carrier strip along weakened lines.

BRIEF DESCRIPTION OF THE DRAWINGS

The organization and manner of operation of the invention, together with the further objects and advantages thereof, may best be understood by reference to the following description taken in connection with the accompanying drawings wherein like reference numerals identify like elements in which:

FIG. 10 is a plan view of a composite illustrative carrier strip having weakened lines for use with the present invention;

FIG. 12 is an enlarged detailed plan view of a movable arm dividing a carrier assembled with a plurality of articles;

FIG. 14 is a perspective view of a plurality of articles assembled with a common carrier forming a discrete package.

DETAILED DESCRIPTION OF THE ILLUSTRATED EMBODIMENT

Figure 1:
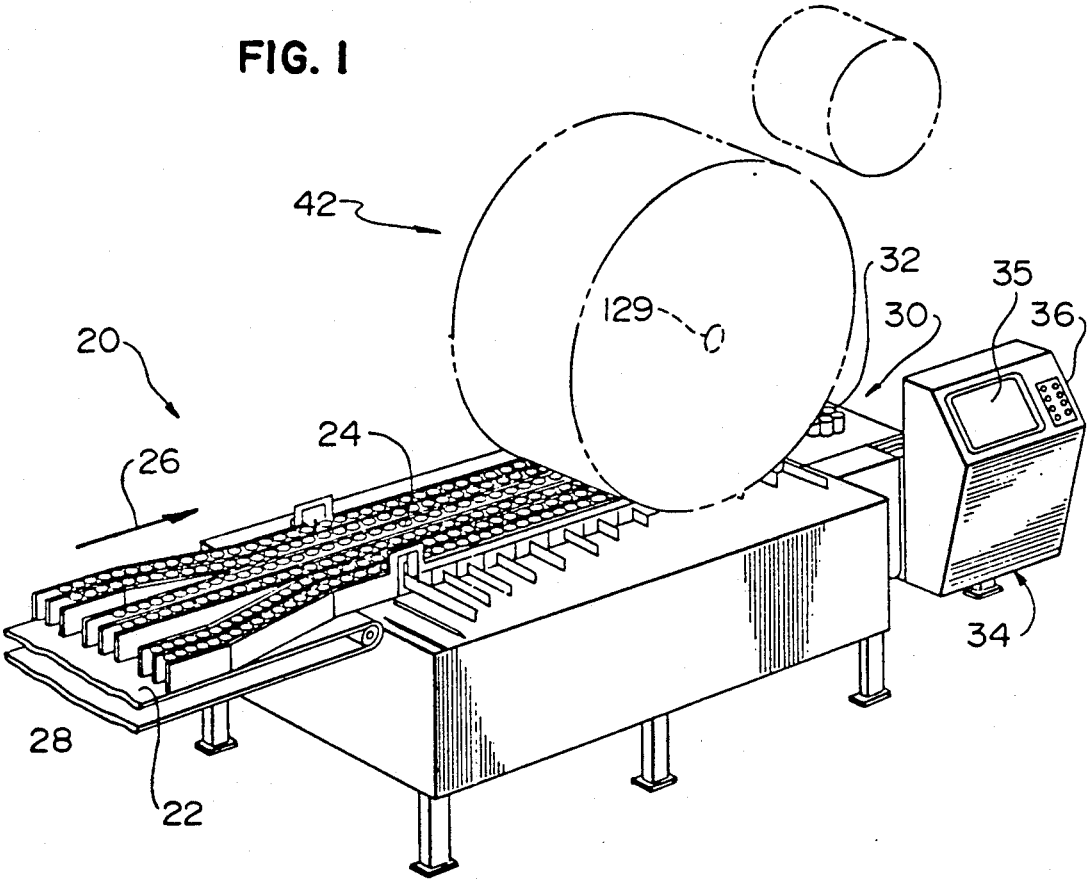
FIG. 1 is a perspective view of an apparatus used in assembling a carrier strip with a plurality of articles.

While this invention may be susceptible to embodiment in different forms, there is shown in the drawings and will herein be described in detail, a specific embodiment with the understanding that the present disclosure is to be considered an exemplification of the principles of the invention, and is not intended to limit the invention to the embodiment illustrated and described herein.

As shown in FIG. 1, the apparatus 20 has conveyor means 22 which deliver a stream or a plurality of articles 24 following a path of travel 26 for packaging. Articles 24 enter the apparatus 20 at an input end 28, are moved along the path of travel 26, and, after being packaged, exit at the output end 30 as discrete packages 32 of articles 24. An electronic controller 34 of known construction including graphics display 35 with function keys 36 and data collection is utilized to control the apparatus 20.

Figure 2:
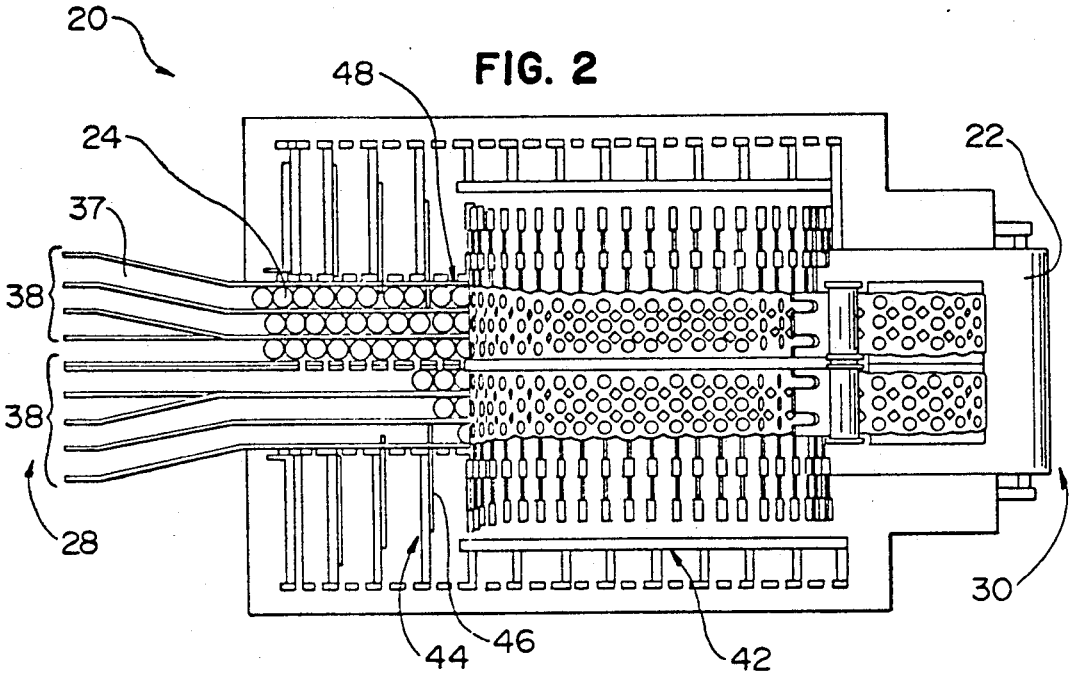
FIG. 2 is a plan view of the apparatus as illustrated in FIG. 1 showing a rotary applicating drum and movable arms used in assembling a carrier strip with a plurality of articles.

FIG. 2 provides a plan view of the apparatus 20 as shown in FIG. 1. The plan view shows six columns 37 of articles 24 moving along the path of travel 26. The six columns 37 are divisible into two lanes 38 each being comprised of three columns 37. As shown in FIG. 2, the articles 24 are transported in the two lanes 38 along the path of travel 26 for assembly with carrier means 40 by assembly means 42.

Separating means 44 are positioned relative to the two lanes 38 and are moved by drive means 45 which move the separating means 44 synchronous with the conveyor means 22. The separating means 44 include reciprocating arms 46 which are positioned between articles 24 moving along the path of travel 26. Articles 24 positioned between two arms 46 form a group 48 of articles 24 to be packaged with the carrier means 40.

As better illustrated in FIG. 10, the carrier means 40 is comprised of a carrier strip 50 formed of a flexible, resilient plastic sheet material having a longitudinal series of transverse article retaining bands 51 having band interconnecting portions or interconnections 52 therebetween to form a strip. Apertures 53 formed through the bands 51 generally are not shaped or sufficiently large to receive the articles 24 with which they are assembled. Rather, the bands 51 are formed of a resilient material such that when stretched, the stretched aperture 53 closely engages an outside surface 55 of the article 24 with which it is assembled.

The carrier strip 50 shown in FIG. 10 is an illustrative composite showing two forms of band interconnections 52: a narrowed neck-like isthmul portion 54*a* on the right side of FIG. 10, and a continuous connected portion 54*b* on the left side of FIG. 10. The continuous connected portion 54*b* is formed by extensions of opposed bands 51 generally continuously extending therebetween. Both forms of band interconnections 52 extend from opposed bands 51 to meet forming a connection therebetween. The interconnections 52 may be formed between every row of bands or a predetermined periodic interval, for example every two rows. Perforated or otherwise weakened tear lines 57 are formed along the interconnections 52 to facilitate separation of the groups 48 of articles 24 assembled with the carrier strip 50 into discrete packages 32 of articles 24.

Figure 3:
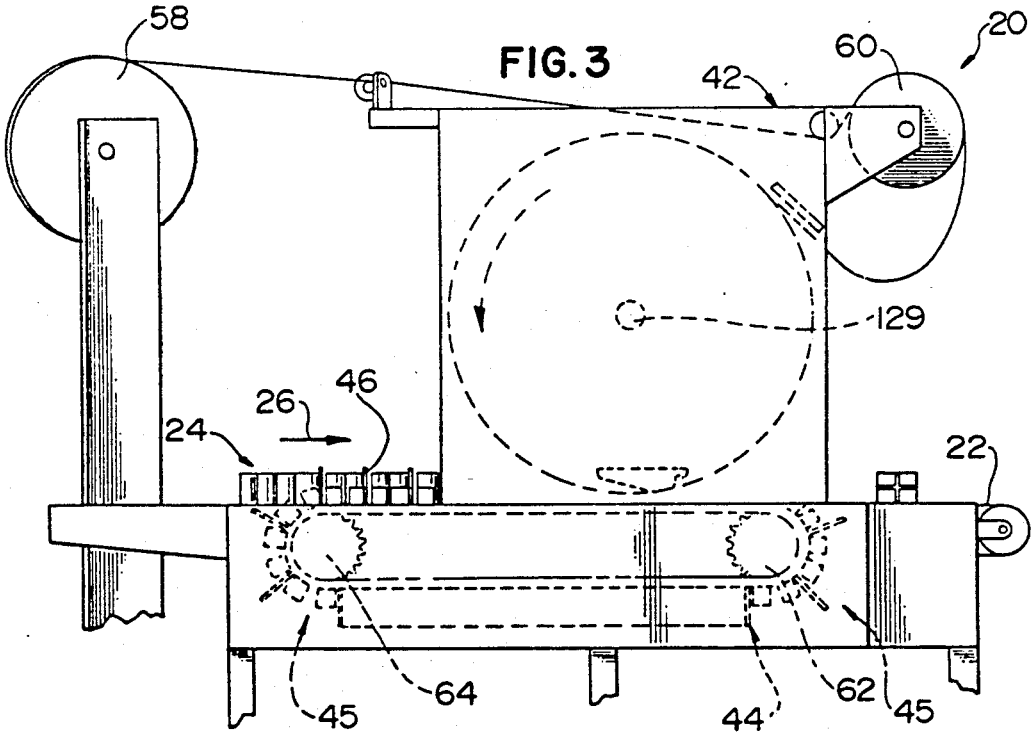
FIG. 3 is a side view of the apparatus illustrated in FIG. 2.

In the side view of the apparatus as illustrated in FIG. 3, a reel 58 of the carrier strip 50 is delivered by delivery means 60 to the assembly means 42. A plurality of articles 24 move along the path of travel 26 through the assembly means 42 whereupon they are assembled with the carrier strip 50 and separated into discrete packages 32. As will be described in further detail hereinbelow, the separating means 44 include a common flight 62 which is driven by sprockets 64 attached to the drive means 45. The arms 46 are attached to the common flight 62 for positioning between groups 48 of articles 24 on the fly. Generally, the common flight 62 is synchronized with the conveyor means 22 so that the arms 46 reciprocally attached thereto are easily insertable between articles 24 moving along the path of travel 26.

Figures 4, 5:
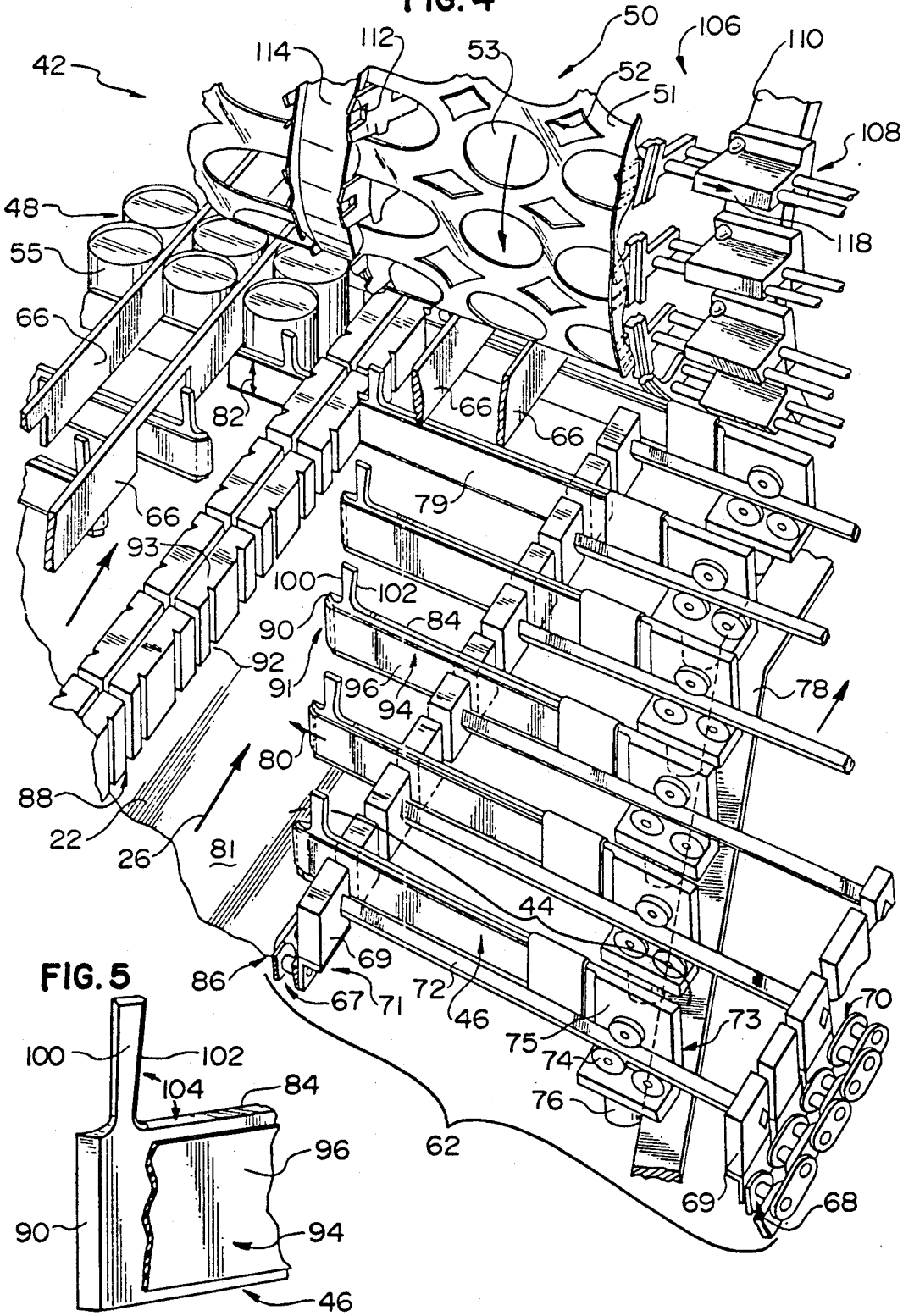
FIG. 4 is a detailed perspective view showing the operation of the movable arms which are insertable between groups of articles for assembly with a carrier strip.
FIG. 5 is an enlarged partially fragmentary view of a free-end of a movable arm showing an angle formed between a leading edge of a blade projecting upwardly therefrom and the top surface of the arm.

FIG. 4 provides an enlarged perspective view looking towards the assembly means 42 from the input end 28. It should be noted that articles 24 have been removed from the lane 38 in the foreground of the view in order to clearly illustrate the operation of the separating means 44. Further, articles 24 have been removed from the background to clearly illustrate movement of the arms 46 through passages 65 formed in column dividers 66 positioned in the lanes 38.

As illustrated in FIG. 4, the common flight 62 is a chain conveyor including two chains, an inside chain 67 parallelly positioned along side of the conveyor means 22 and an outside chain 68 parallelly positioned along side and spaced apart from the inside chain 67. Footing blocks 69 are mounted at periodic spacings on a conveyor facing edge 70 of the outside chain 68 and an outwardly facing edge 71 of the inside chain 67 along the common flight 62. Rails 72 are attached to opposing pairs of footing blocks 69 generally perpendicularly between the pair of common flight 62 chains 67, 68. The rails 72 provide a structure capable of moving with the common flight 62 while providing a support on which the arms 46 reciprocate.

Movement of the arms 46 along the rail 72 is accomplished by reciprocating means 73 to which the arms 46 are attached. Reciprocating means 73 include a generally "L"-shaped body portion 75 and rotatable wheels 74. The wheels 74 are mounted to the body portion 75 and engage the rail 68. With the arm 46 mounted to the body portion 75, movement of the body portion 75 results in movement of the arm 46 thereattached.

Reciprocation of the reciprocating means 73 and the attached arm 46 is achieved through a camming arrangement. Each body portion 75 of the reciprocating means 73 has a cam pin 76 attached to the underside thereof. The cam pin 76 movably engages a camming track 78 which is generally non-parallely directed with respect to the conveyor 22 resulting in reciprocally urging the arm 46 in between or out from a group 48 of articles 24.

As shown in FIG. 4, the arms 46 are relatively flat generally rigid elongate members. When fully extended perpendicularly across the path of travel 26, a length dimension 79 of the arm sufficiently spans the entire width of the path of travel 26. As well as reciprocally inserting in between groups of articles 48 (as indicated by arrow 80), the arms 46 travel synchronously in the direction of the path of travel 26 generally in close relation to a top surface 81 of the conveyor means 22. In the present embodiment, a height dimension 82 of the arms 46 is at least less than one-half of the article height, but may be shorter or taller than conventional articles. Dimensioned as such, the arms 46 helps support and move articles 24 in the direction of the path of travel 26 as well as retain the articles 24 in upright parallel alignment.

Once the arm 46 is fully extended from an outside edge 86 to an inside edge 88 of the conveyor 22, a locking tip 90 formed on a free end 91 of the arm 46 mates with a cooperatively dimensioned and positioned notch 92 formed on a notched footing block 93 positioned on the inside edge 88 of the conveyor 22. Engagement of the locking tip 90 with the notch 92 prohibits flexing of the arm 46 against the path of travel 26 thereby increasing retention of the group 48 of articles 24 in close relation.

To further improve reciprocation of the arm 46 in between and out from groups 48 of articles 24, friction reducing material 96 is attached or applied to article abutting surfaces 94 of the arm. The friction reducing material 96 prevents damage to the outside surface 55 of the articles 24 positioned thereagainst. The friction reducing material 96 therefore promotes grouping of the articles 24, protection of the outside surfaces 55 of the articles 24 and protection of the assembly process by preventing damage to the articles 24 the contents of which could impair the operation of and hence the processing rate of the apparatus 20.

As shown in FIG. 4, and with greater detail in FIG. 5, a blade member 100 extends upwardly away from the top edge 84 of the arm 46. As illustrated and described in greater detail hereinbelow, the blade member 100 promotes separation of the groups 48 of articles 24 once the carrier strip 50 is assembled therewith. The blade member 100 is attached to the arm 46 towards the free end 91 and has a leading edge 102 shaped to promote separation of the carrier strip 50 upon extraction of the arm 46. An angle 104 generally equal to or less than 90° is formed between the leading edge 102 and the top edge 84 of the arm 46. This angle 104 promotes retention of the carrier 50 on the articles 24 assembled therewith by preventing the carrier material 50 from being forced upwardly along the outside surface 55 of the articles 24 as the arm 46 is extracted from between a group 48 of articles 24.

FIG. 4 further illustrates the relative movement of the various components of the apparatus 20 from the input end 28. The general direction of movement in this area 28 is coincident with the path of travel 26. As shown in FIG. 4, the conveyor means 22, the inside chain 67 and outside chain 68 of the common flight 62, as well as the attached separating means 44 components and the notched blocks 93, synchronously move along a common path of travel 26. At the input end 28 of the apparatus 20, the camming track 78 is angled inwardly towards the conveyor means 22 such that the reciprocating means 73 follow an angular path inwardly towards the conveyor means 22 along the path of travel 26. The angular movement of the reciprocating means 73 moves the arms 46 attached thereto in a perpendicular direction 80 relative the path of travel 26 while moving synchronously in the path of travel 26.

Assembly means 42 include a rotary application drum 105 which rotates in a complementary direction to the path of travel 26 to assemble the carrier strip 50 retained thereon with the articles 24 moving thereunder. As shown in FIG. 4, the carrier strip 50 is retained on the rotary application drum 105 by a carrier engaging assembly or application jaw stations 106. The application jaw stations 106 are a combination of reciprocal jaws 108 positioned along an outside edge 110 of the drum 105 and stationery jaws 112 fixedly positioned along a central portion 114 of the drum 105. With the jaws 108, 112 projecting through the outer most apertures 53 of the carrier strip 50, the reciprocal jaws 108 are outwardly cammed, as indicated by the arrow 118, stretching the carrier 50 away from the stationery jaw 112. By stretching the carrier 50, the apertures 53 formed therethrough are sufficiently enlarged to permit assembly of the carrier 50 with the articles 24. Further detail of the structure of the application jaw stations 106 is provided hereinbelow in the description accompanying FIGS. 6 and 7.

Figure 6:
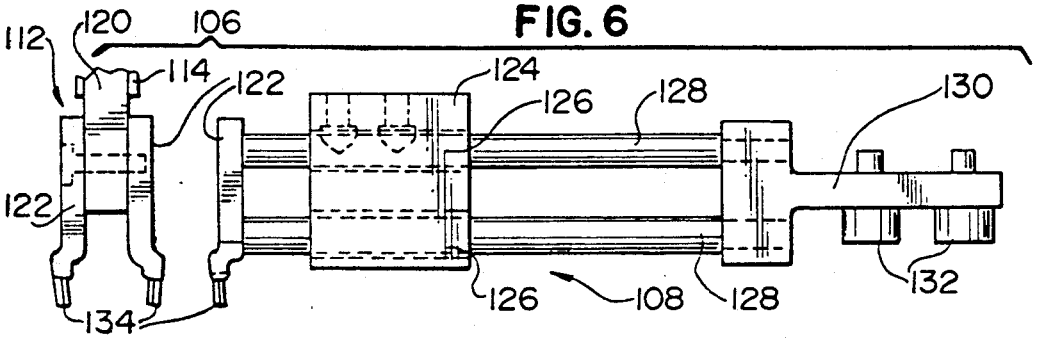
FIG. 6 is a side view of a carrier strip engaging assembly which is used to elastically deform the engaged carrier strip for assembly with articles.
Figure 7:
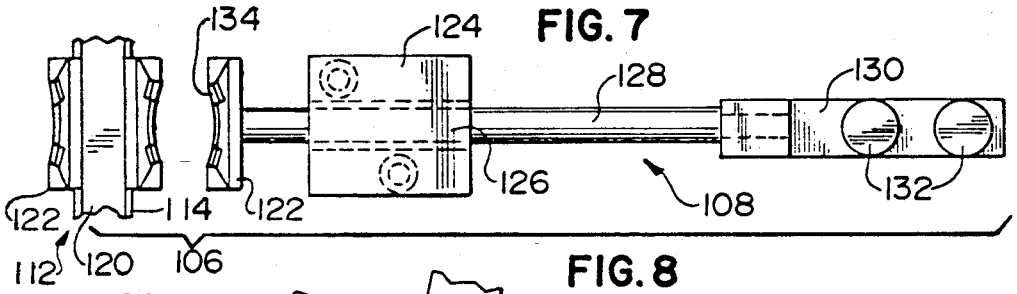
FIG. 7 is a top view of the carrier strip engaging assembly as illustrated in FIG. 6.
Figure 8:
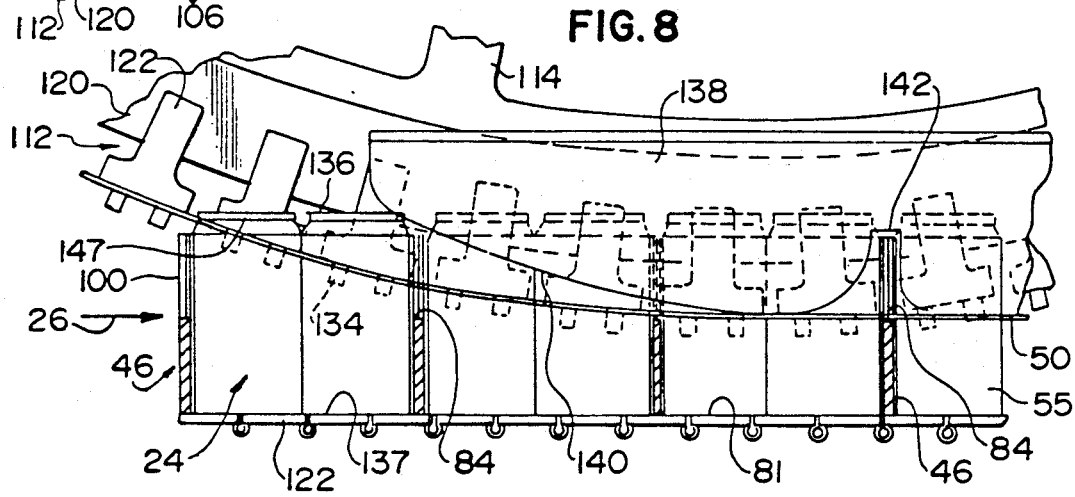
FIG. 8 is an enlarged partial fragmentary side view of a group of articles passing beneath the rotary applicating drum applying the carrier strip intermediate a top and bottom of the article and a fin positioning the carrier strip and removing the carrier strip from the rotary applicating drum.
Figure 9:
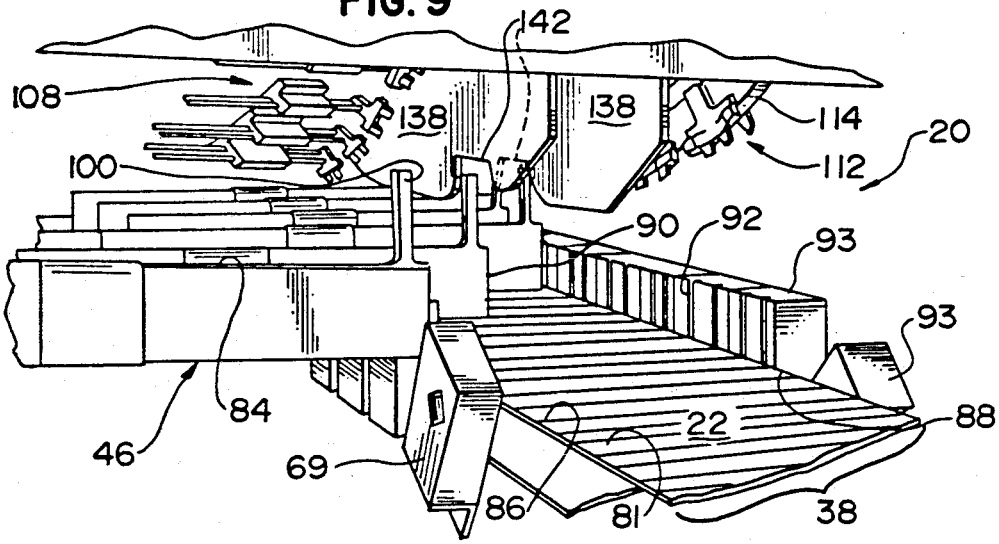
FIG. 9 is a detailed perspective view of the apparatus as viewed from the output side of the apparatus showing the movable arms being retracted transversely horizontally to the path of travel.

FIGS. 6 and 7 provide enlarged side and bottom views of the application jaw stations 106. As shown in FIGS. 4, 8 and 9, the application jaw stations 106 are mounted to the rotary application drum 105 and have reciprocal jaw portions 108 which are cammingly moved to stretch the carrier 50. Each of the application jaw stations 106 is comprised of a stationary block 120 mounted on the central portion 114 of the drum 105 to which is stationarily mounted a pair of opposed jaw plates 122. Each stationary jaw plate 122 has a corresponding cooperatively positioned reciprocal jaw assembly 108 mounted generally on the outside of the rotary application drum 105. It is to be noted that FIGS. 6 and 7 only illustrate one reciprocal jaw 108 and both stationary jaws 112 of the application jaw stations 106.

The reciprocal jaw 108 is secured to the rotary application drum 105 by mounting block 124 which has two bores 126 formed therethrough. The jaw plate 122 of the reciprocal jaw 108 is secured to a pair of operating rods 128 which are radially or vertically stacked relative to an axis 129 of the drum 105 permitting closer spacing of the application jaw stations 106 around the circumference of the rotary application drum 105 and providing sufficient clearance for arms 46. The operating rods 128 project through and are slidably retained within the corresponding bores 126. Ends of the operating rods 128 distal the jaw plate 122 are secured to a cam follower block 130. The cam follower block 130 is formed with rollers 132 which follow a camming track positioned near the outermost edge of the rotary application drum 105. The camming track is angled inwardly towards and outwardly away from the articles 24 moving underneath the rotary application drum 105 to urge the reciprocal jaw 108 inwardly towards the center of the drum 105 and outwardly therefrom via mechanical engagement with the rollers 132.

When the camming track (not shown, but similar in operation to the mechanisms as shown in U.S. Pat. No. 4,250,682 to Braun) is angle inwardly towards the drum 105, the reciprocal jaw 108 is slidably moved towards the stationary jaw 112. At a position where the stationary and reciprocal jaws 112, 108 have moved sufficiently close to each other, the carrier material is positioned over fingers 134 on the respective jaw plates 122. After the carrier material has been positioned over the fingers 134, the camming track angles outwardly away from the stationary jaw 112 thereby moving the jaw plate 122 of the reciprocal jaw 108 away from the stationary jaw 112. As the reciprocal jaw 108 moves away from the stationary jaw 112, the carrier material positioned on the respective fingers 134 thereof is stretched to enlarge the apertures 54 a sufficient dimension to permit assembly with articles 24. The positioning of the carrier material 50 on the application jaw stations 106 and stretching of the carrier material 50 is performed in a high speed rotary motion as the application jaws 106 are mounted to the outer surface of the rotary application drum 105. As the application drum 105 rotates in a complementary direction to the path of travel 26, the apertures 53 are positioned over corresponding articles 24 moving thereunder.

FIG. 8 provides greater detail of the point at which the carrier material 50 is assembled with the articles 24 moving thereunder. The view illustrated in FIG. 8 is taken looking towards the central portion 114 of the drum 105 through a single column of articles 37 moving along the path of travel 26. As shown in FIG. 8, the stationary jaws 112 include the jaw plate 122 mounted to the stationary jaw block 120 and the corresponding fingers 134. Carrier material 50 is stretched and retained on the stationary fingers 134 and positioned over a top portion 136 of the articles 24 moving thereunder. The diameter of the application drum 105 permits a shallow angle of approach or slope in applying the carrier material 50 over tops 136 of the articles 24. Further, the diameter of the rotary drum 105 is dimensioned to permit delivery of the carrier material 50 to a midpoint 135 positioned substantially spaced from top and bottom portions 136, 137 of the articles 24. As an alternative, the application drum 105 is eliminated and the application jaw stations 106 are mounted to a moving flight or other moving application jaw stations 106 retaining structure. Use of an alternative to the drum 105 decreases the angle of approach of the carrier material 50 being applied to the articles 24.

Once the carrier material 50 is positioned over the articles 24, a fin 138 helps to position the carrier downwardly onto the outside surfaces 55 of the articles 24. The fin 138 in frictional engagement between the carrier bands and surfaces 55 assists in peeling the carrier 50 off of the jaw fingers 134 as the rotary application drum 105 sweeps the application jaw stations 106 upwardly away from the articles 24 in a rotary motion. The fin 138 is formed with a gently sloping leading edge 140 providing minimum interference with the application jaw stations 106 and the carrier material 50 retained therebetween. The exit side of the blade 138 is likewise curved to prevent snagging of the carrier material 50 as it peels from the application jaw stations 106. Once the carrier strip 50 is assembled with the articles 24, the arm 46 positioned between groups 48 of articles 24 is extracted from between the group 48 of articles 24. To avoid interference between the moving arm 46 with the fin 138, a passage notch 142 is formed through the fin 138. The passage notch 142 is positioned at an appropriate location determined by the path of travel of the arm 46 being extracted from between the groups 48 of articles 24 as the articles 24 move along the path of travel 26.

As shown in FIG. 9, two fins 138 separate each lane 38 into three (3) single article columns 37. The fins 138 illustrated in FIG. 9 are formed with passage notches 142 to permit movement therethrough of the upstanding blade portion 100 mounted to the top 84 of the arm 46. Although articles 24 have been omitted from FIG. 9, it can be seen that the reciprocal arms 46 are fully extracted from out of the path of travel 26 at the output end 32 of the apparatus 20. As shown, the footing blocks 69 along the outside edge 86 of the conveyor 22 and the notched footing blocks 93 along the inside edge 88 of the conveyor 22 are rotated downwardly away from the top 81 of the conveyor 22 since they are attached to the synchronized common flight 62 which is engaged with a sprocket 64 or other drive means 45 for moving the common flight 62.

Figure 11:
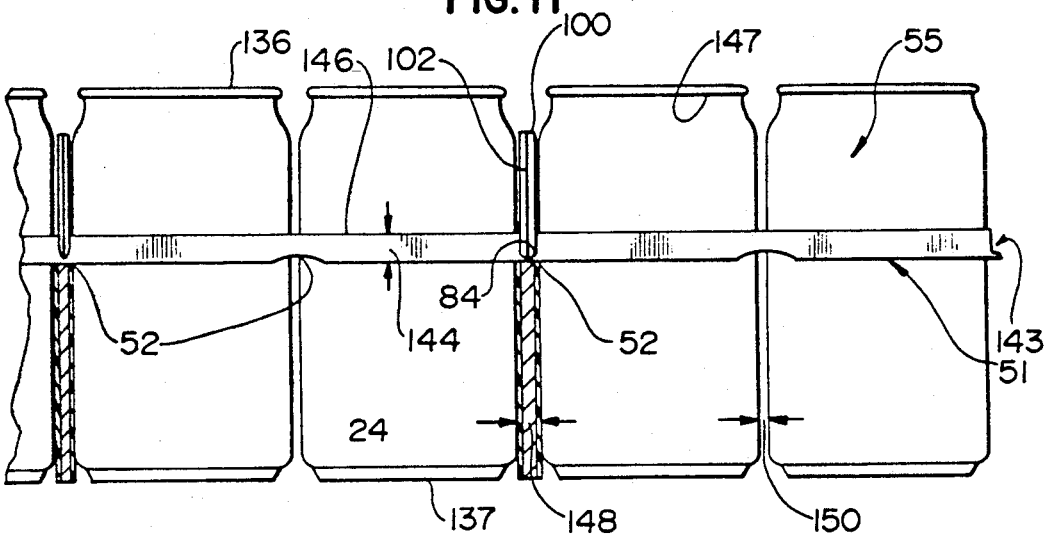
FIG. 11 is a partial fragmentary side elevational view of a plurality of articles moving along a path of travel which have been assembled with a carrier strip having reciprocal arm members positioned therebetween.

FIG. 11 provides an enlarged side elevational view of a plurality of articles 24 having a reciprocal arm 46 (shown in cross section) being extracted from therebetween. In FIG. 11 various portions of the apparatus 20 have been omitted in order to provide greater clarity in describing the means and function of the present invention. As shown, the carrier 50 is positioned substantially from the top 136 and the bottom 137 of the articles 24, such position in part being determined and maintained by the fin 138 described above. The strip of carrier material 50 assembled with the articles 24 as such defines a plane 143 through which the blade 100 upwardly projects.

With reference to FIG. 8, the carrier 50 is generally formed of a thin sheet material such as 0.012 to 0.016 polyethylene such that when apertures 53 are formed therethrough, the retaining bands 51 have a width dimension or band surface 144 which is greater than the thickness of the carrier material 50. As shown in FIG. 11, the band surface 144 lies flat against the outside surface 55 of the article 24 and an internal edge 146 of the aperture 53 is oriented in an upward direction but is not positioned directly under the chime 147 of the article 24 as typified in prior art packages.

As further shown in FIG. 11, positioning of the arm 46 between articles 24 creates tension in the band interconnections 52. The tension in the band interconnections 52 is a function of the cross sectional thickness 148 of the arm 46. By comparing a dimension 150 between the outside surfaces 55 of two articles 24 with the carrier material 50 assembled therewith in a relaxed state (no arm 46 positioned therebetween) and articles 24 having an arm 46 positioned therebetween, it can be seen that the articles 24 with the arm 46 therebetween are forced apart thereby creating tension in the carrier strip 50 along the band interconnections 52.

A top view of the arrangement as illustrated in FIG. 11 is shown in FIG. 12. As shown in FIG. 12, the arm 46 is engaged with the camming track 78 by the camming pin 76 attached to the L-shaped body portion 75. The camming track 78 is angled away from the path of travel 26 thereby extracting the arm 46 from between the groups 48 of articles 24. The locking tip 90 is shown as having been disengaged from the locking notch 92 formed in the corresponding notched block 93. The blade 100 formed on the free end 91 of the arm 46, while being extracted perpendicular relative to the path of travel 26, follows an apparently angular extraction path as indicated by line 152. The extraction path 152 passes through the passage notches 142 formed in the fins 138 as noted hereinabove.

As the arm 46 is extracted from between the groups of articles 48, the leading edge 102 of the blade 100 passes through perforated or weakened line 57 formed in the band interconnections 52 to separate the groups 48 of articles 24. Tension created in the carrier material 50 at the band interconnections 52, by thickness 148 as noted above, promotes separation along the weakened lines 57 as the blade 100 moves therethrough. It is noted that the leading edge 102, although beveled, is not sufficiently sharp to cut the carrier material 50. To the contrary, the edge 102 is preferably blunt so as to promote a tearing or separating action rather than a cutting action.

Figure 13:
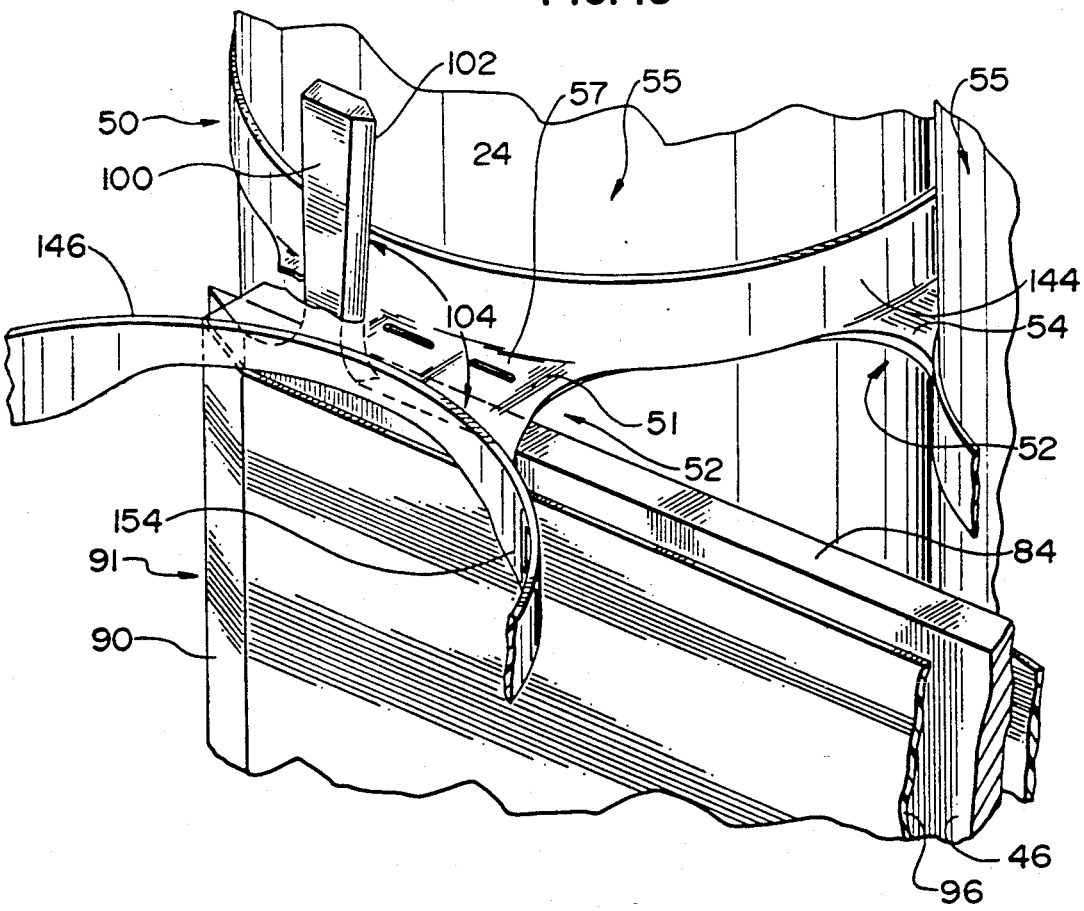
FIG. 13 is an enlarged partial fragmentary perspective view of a blade attached to a reciprocating arm separating a weakened isthmul connection between two article retaining hands.

As shown in FIGS. 12 and 13, the effect of the blade 100 attached to the reciprocal arm 46 moving along the weakened lines 57 formed along the band interconnections 52 of the carrier 50 results in unzipping groups 48 of articles 24. Analogus to a zipper used on clothing, the blade 100 performs the function of a slider which separates opposed joined structures (i.e. the band interconnections 52). When the arm 46 is removed from between groups 48 of articles 24 the blade 100 unzips the carrier material 50 joined at the band interconnections 52. Weakening of the material by perforating or forming weakened lines 57 further facilitates the unzipping action and function of the separating means 44.

FIG. 13 provides an enlarged perspective view of the blade 100 moving through the band interconnections 52 as illustrated in FIG. 12. As shown in FIG. 13, the band surfaces 144 lie against the outside surface 55 of the articles 24. Further, the internal edge 146 of the aperture 53 is shown in its upward orientation. Although the article 24 in the foreground of the perspective view has been removed to provide clarity in the illustration, the outside surface 55 of the article 24 in the foreground abuts the friction reducing material 96 on the outside of the arm 46 placing the corresponding band interconnection 52 in tension to promote the unzipping or separation of the carrier material 50 along the weakened line 57 by the leading edge 102.

As shown in FIG. 13, the angle 104 of the blade member 100 being generally equal to or less than 90° does not urge the carrier upwardly as the arm 46 is extracted from between the groups of articles 48. The angle 104 between the blade 100 and the arm 46 is important when the leading edge 102 does not cut through the carrier material 50. When the leading edge 102 separates the carrier material 50, if not for the right or acute angle 104, the frictional forces between the leading edge 102 may become greater than the frictional forces between an inwardly facing surface 154 of the band surface 144 and the abutting outside surface 55 of the article 24 which could cause the carrier to move upwardly out of the desired position.

A group 48 of articles 24 is illustrated in FIG. 14, wherein 12 articles have been grouped together as a discrete package 32 of articles 24 retained by a common portion of carrier 50. In contrast to producing "6-paks", such a "12-pak" can be created by selectively engaging or activating the cam pin 76 of every other arm 46 on the apparatus as arranged in FIG. 4 instead of every arm as illustrated. Alternatively, every other arm 46 could be removed from the common flight 62 such that 12 articles are positioned between every two arms 46.

While a preferred embodiment of the present invention is shown and described, it is envisioned that those skilled in the art may devise various modifications of the present invention without departing from the spirit and scope of the appended claims.

The invention is claimed as follows:

1. An apparatus for assembling a plurality of articles with carriers in a strip of connected carriers and for separating the strip of carriers forming discrete packages of a plurality of articles, said apparatus comprising: conveyor means for moving articles along a path of travel; assembly means adjacent said path of travel for assembling the carriers over ends of a plurality of articles; carrier delivery means for delivering a strip of carriers along said path of travel; separating means operable from at least one side of said articles moving along said path of travel for horizontally dividing the strip of carriers transversely to the direction of movement of the articles along said path of travel; said separating means further comprising a common flight positioned along at least one side of said path of travel and synchronized with said articles moving along said path of travel, a series of arms operatively attached to said common flight for insertion between articles moving along said path of travel, a free end of each arm distal said common flight, a blade member extending from said free end of each arm for extending through a plane formed by the carriers assembled with a corresponding plurality of articles, reciprocating means for horizontally transversely extracting said arms from between said articles moving along said path of travel such that when said arms from which said blades extend are horizontally transversely extracted from between said articles said carriers are separated into discrete packages of a plurality of articles.

2. An apparatus according to claim 1 further comprising a leading edge of said blade member positioned facing said common flight, said leading edge formed at an angle of generally equal to or less than 90° relative to said arm from which said blade member extends for preventing said carrier from moving upwardly along said article to which said carrier is assembled when said arm is withdrawn from between said articles and said carrier is separated by said blade member.

3. An apparatus according to claim 1 further comprising friction reducing material applied to said arms for reducing friction between said arm and said articles when said arms are positioned between successive groups of articles, moved along said path of travel with said articles and withdrawn from between articles.

4. An apparatus according to claim 1 wherein said separating means further comprises arm receiving means synchronously positioned along said path of travel opposite said free end of said arms, for receiving and releasably retaining said free end of said arms once said arms are inserted between said articles, each of said arms receiving means formed with a notch sized and dimensioned for receiving said free end for preventing deflection of said arms once inserted between said articles.

5. An apparatus according to claim 1 wherein said arms are selectively activated by said common flight for adjustably controlling the number of articles in the successive group of articles between which said arms are removably positioned.

6. An apparatus for assembling a plurality of articles moving along a path of travel in at least three generally parallel columns of articles with carriers of predetermined width transversely of said path of travel in a strip of carriers moving along said path of travel and for separating the strip of carriers at intervals forming discrete packages of a plurality of articles, said apparatus comprising: assembly means adjacent said path of travel for assembling the carriers over ends of a plurality of articles; separating means including arm members extending for a length at least substantially equal to said width perpendicular to said path of travel and operating from at least one side of said articles moving along said path of travel for extending across at least three columns of articles for dividing the strip of carriers into packages transversely to the direction of movement of the articles along said path of travel.

7. An apparatus as in claim 6 wherein said separating means further includes tensioning means for applying a tensioning force to the carriers to facilitate separation of the carriers.

8. An apparatus for assembling a plurality of articles with carriers in a strip of carriers connected along perforated or otherwise weakened spaced tear lines extending transversely of the strip, said apparatus comprising: conveying means for advancing a stream of articles along a path of travel; carrier delivery means for advancing said strip of carriers along said path of travel; assembly means for assembling the carriers in said strip over ends of successive groups of articles in said stream; tensioning means for exerting a tensioning force on the strip and said weakened tear lines between adjacent groups of articles in a direction longitudinally of the strip, said tensioning means comprising an arm positionable between adjacent groups of articles, said arm dimensioned for spacing said articles to create a tensioning force on the strip when assembled with said articles; and separating means for applying a separating force from one side edge of the strip toward an opposite side edge and along successive tensioned weakened tear lines for separating successive carriers from each other, said tensioning force promoting separation of said strip by said separating means; said separating means further comprising a common flight positioned along at least one side of said path of travel and synchronized with said articles moving along said path of travel, a series of arms operatively attached to said common flight positionable between articles moving along said path of travel, a free end of each arm distal said common flight, a blade member extending from said free end of each arm for extending through a plane formed by the carriers assembled with a corresponding plurality of articles, reciprocating means for horizontally transversely extracting said arms from between said articles moving along said path of travel such that when said arms from which said blades extend are horizontally transversely extracted from between said articles and carriers are separated into discrete packages of a plurality of articles.

9. An apparatus according to claim 8 further comprising a leading edge of said blade member is positioned facing said common flight, said leading edge formed at an angle of less than 90° relative said arm from which said blade member extends for preventing said carrier from moving upwardly along said article to which said carrier is assembled when said arm is withdrawn from between said articles and said carrier is separated by said blade member.

10. An apparatus as defined in claim 9, wherein said separating means includes spacing means for successively spacing said groups of articles from adjacent groups of articles for tensioning the strip between the spaced groups such that when the carriers are applied over the ends of the spaced groups, the strip is tensioned thereby and therebetween.

11. An apparatus for assembling a plurality of articles with carriers in a strip of carriers connected along perforated or otherwise weakened tear lines extending transversely of the strip, said apparatus comprising: conveying means for advancing at least two columns of articles along a path of travel; carrier delivery means for advancing said strip along said path of travel; assembly means for assembling the carriers in said strip with groups of articles in said path of travel substantially spaced apart from a top and a bottom portion of said articles; tensioning means for exerting a tensioning force on the strip and said weakened tear lines between adjacent groups of articles in a direction generally longitudinally and laterally of said strip; and separating means for unzipping said strip from one side edge of said strip to an opposite side edge along said tensioned weakened tear line for separating carriers from each other.

12. An apparatus according to claim 11 wherein said tensioning means includes an arm positionable between adjacent groups of articles and dimensioned for spacing said articles to create a tensioning force on said strip when assembled with said articles, said tensioning force promoting unzipping of said strip by said separating means.

13. An apparatus for assembling a plurality of articles with carriers in a strip of carriers connected along perforated or otherwise weakened tear lines extending transversely of the strip, said apparatus comprising: conveying means for advancing at least two columns of articles along a path of travel; carrier delivery means for advancing said strip along said path of travel; assembly mean for assembling the carriers in said strip with groups of articles in said path of travel substantially spaced apart from a top and a bottom portion of said articles; tensioning means for exerting a tensioning force on the strip and said weakened tear lines between adjacent groups of articles in a direction generally longitudinally and laterally of said strip; and separating means for unzipping said strips from one side edge of said strip toward an opposite side edge and along successive tensioned weakened tear lines for separating successive carriers from each other, said separating means includes a common flight positioned along at least one side of said path of travel and synchronized with said articles moving along said path of travel, a series of arms operatively attached to said common flight positionable between articles moving along said path of travel, a free end of each arm distal said common flight, a blade member extending from said free end of each arm for extending through a plane formed by said strip assembled with a corresponding plurality of articles reciprocating means for horizontally transversely moving said arms between said articles moving along said path of travel such that when said arms from which said blades extend are horizontally transversely moved between said articles said strip is unzipped along said weakened tear lines forming discrete packages of a plurality of articles.

14. A system for packaging articles in groups of a articles of articles comprising means for conveying a stream of said articles in at least three rows moving continuously along a predetermined path of travel, means for feeding a strip of carriers of thin resilient sheet material moving along said path of travel and interconnected along interconnecting portions extending transversely of said path of travel, a series of interconnecting portions forming a junction line between successive carriers in said strip ends of said junction line being located at opposite edges of said carrier strip, means adjacent said path of travel for successively assembling the carriers forming said strip with successive groups of said articles moving along said path of travel to provide successive packages; means adjacent to and generally moving continuously in an endless path synchronously with said articles moving along said path of travel and insertable transversely of said path of travel for successively separating the packages by initiating separation of the carrier at one end of each junction line and continuing such separation to an opposite end of each junction line while the packages are continuously moving along said path of travel and means adjacent said path of travel tensioning said strip along said junction lines for facilitating separation of the carrier at said junction line.

15. A system for packaging articles according to claim 14 wherein said strip is perforated or otherwise weakened along said junction lines and said separating means comprise means for tearing said strip along said weakened junction lines.

16. A system for packaging articles according to claim 15 which includes a second strip of said first strip, said assembly means comprise means for assembling carriers of said second strip with successive groups of articles to provide packages moving along said path of travel, and said separating means including means for separating said packages of said second strip from each other with bottoms and tops of said article respectively at first and second levels and midportions of the articles at a third level.

17. A method for assembling a plurality of articles with carriers in a strip of connected carriers and for separating the strip of carriers forming discrete packages of a plurality of articles, said method comprising conveying said articles along a path of travel; advancing a series of spaced arms having free ends with upstanding blade members along a side of said path of travel and inserting said free ends of said arms at spaced intervals between successive groups of articles; delivering a strip of carriers along said path of travel; assembling the carriers over ends of said successive groups of articles; withdrawing said arms and blade members from between the groups of articles with carriers assembled therewith and thereby separating the strip of carriers into packages from at least one side of said articles moving along said path of travel horizontally transversely to the direction of movement of the articles along said path of travel.

18. A method according to claim 17 further comprising positioning said carriers substantially spaced from and intermediate top and bottom portions of said articles.

19. A method of assembling a plurality of articles with carriers in a strip of carriers of predetermined width connected along perforated or otherwise weakened spaced tear lines extending tranversely of the strip said method comprising: advancing a stream of articles and said strip along a path of travel; successively assembling the carriers in said strip over said ends of successive groups of articles in said stream; providing tensioning means, initially tensioning the entire width of the strip and said weakened tear lines between adjacent groups of articles with said tensioning means in a direction longitudinal of the strip and then applying a tearing force with a tearing means from one side edge of the strip toward and opposite side edge and along a predetermined tensioned weakened tear line for separating successive carriers from each other.

20. A method as defined in claim 19, which includes successively spacing said groups of articles from adjacent groups of articles, applying the carriers over the ends of the spaced groups and thereby tensioning the strip between the spaced groups.

* * * * *

UNITED STATES PATENT AND TRADEMARK OFFICE

CERTIFICATE OF CORRECTION

PATENT NO. : 5,117,609

DATED : June 2, 1992

INVENTOR(S) : Lonnie R. Seymour and Kevin D. Moore

It is certified that error appears in the above-indentified patent and that said Letters Patent is hereby corrected as shown below:

On the title page, Item [54] and Column 1, line 1,

"APPARAQUS AND METHOD FOR APPLYING A MULTI-PACKAGE CARRIER"
should be --APPARATUS AND METHOD FOR APPLYING A MULTI-PACKAGE CARRIER --.

Column 7, line 21, "close to each other, the carrier material is" should be -- close to each other, the carrier material 50 is --.

Column 13, line 9, "articles of articles" should be -- plurality of articles --.

Column 13, line 40 after "said" insert --carriers moving along said path of travel adjacent said --.

Signed and Sealed this

Fourteenth Day of September, 1993

Bruce Lehman

*Attest:*

BRUCE LEHMAN

*Attesting Officer*

*Commissioner of Patents and Trademarks*